United States Patent [19]

Bijma et al.

[11] 4,358,703

[45] Nov. 9, 1982

[54] CATHODE-RAY TUBE

[75] Inventors: Jan Bijma; Henricus W. M. Linssen, both of Eindhoven, Netherlands

[73] Assignee: U.S. Philips Corporation, New York, N.Y.

[21] Appl. No.: 207,581

[22] Filed: Nov. 17, 1980

Related U.S. Application Data

[63] Continuation of Ser. No. 956,767, Nov. 1, 1978, abandoned.

[30] Foreign Application Priority Data

Nov. 24, 1977 [NL] Netherlands ..... 7712942

[51] Int. Cl.[3] ..... H01J 29/56; H01J 29/46

[52] U.S. Cl. ..... 313/448; 313/460

[58] Field of Search ..... 313/458, 460, 448

[56] References Cited

U.S. PATENT DOCUMENTS

| | | | |
|---|---|---|---|
| 3,497,763 | 2/1970 | Hasker | 313/437 X |
| 3,852,608 | 12/1974 | Johanns et al. | 313/449 |
| 4,143,293 | 3/1979 | Hosokoshi et al. | 313/409 |

*Primary Examiner*—Robert Segal

*Attorney, Agent, or Firm*—Robert J. Kraus

[57] ABSTRACT

By making the first grid of an electron gun for a cathode-ray tube to extend in the manner of a funnel in such manner that on the side of the second grid the aperture is elongate and mainly a quadrupole lens action is obtained, it is possible to obtain in the corners and at the edge of the display screen a spot which is surrounded by considerably less haze than the known construction having an elongate aperture in the first grid.

15 Claims, 12 Drawing Figures

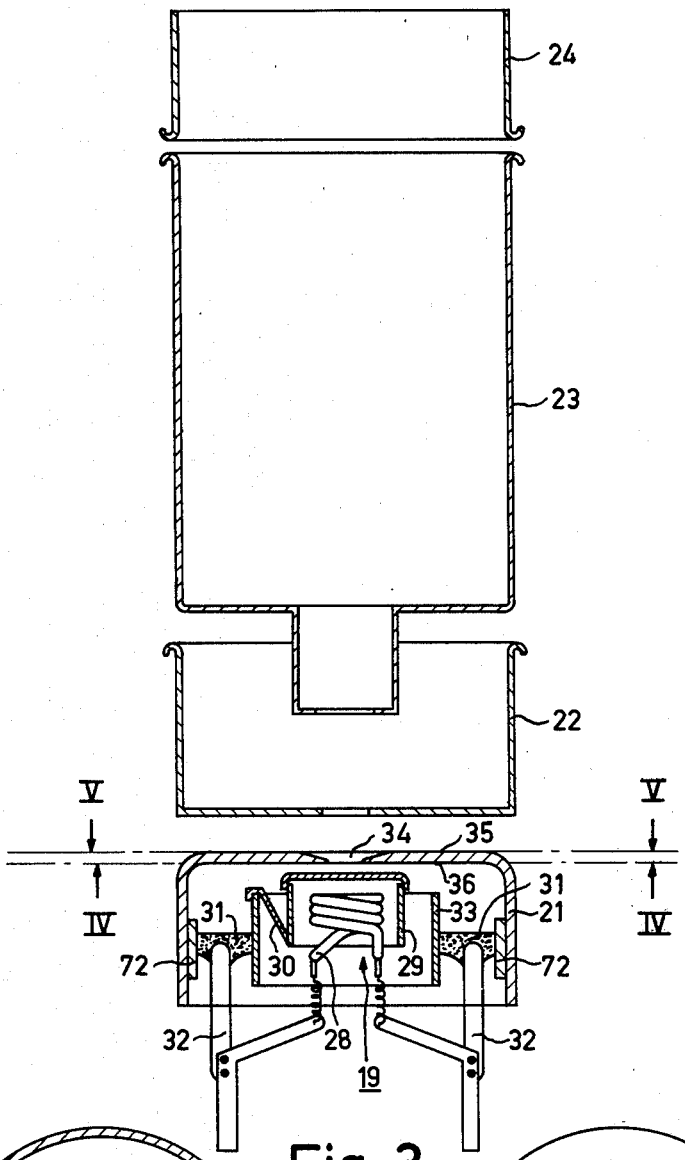
Fig. 3
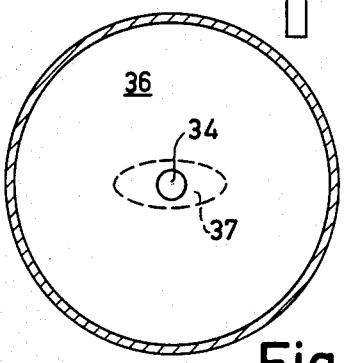
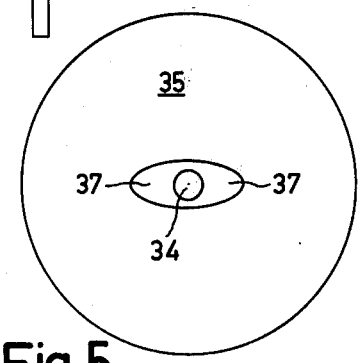
21 21
Fig. 4 Fig. 5

CATHODE-RAY TUBE

This is a continuation of application Ser. No. 956,767, filed Nov. 1, 1978, now abandoned.

BACKGROUND OF THE INVENTION

The invention relates to a cathode-ray tube comprising, in an evacuated envelope, an electron gun for generating an electron beam directed onto a target, the electron gun being comprised successively of a cathode centred around an axis, a first grid and a second grid, the first grid forming with the second grid a non-rotationally symmetrical electron lens, mainly a quadrupole lens.

Such a cathode-ray tube may be used for displaying television pictures or in an oscilloscope. In that case the target is a display screen having a phosphor layer or a pattern of phosphor elements luminescing in different colours. Such a tube may also be used for recording pictures. In that case the target is a photoconductive layer. In all such applications it is desirable to have a spot of certain dimensions and without a surrounding haze.

Such a cathode-ray tube is disclosed in U.S. Pat. No. 3,497,673, Hasker. The first grid of the electron gun of the tube there described is provided with an elongated aperture which, in cooperation with the second grid, forms a non-rotationally symmetrical electron lens, which asymmetry is expressed mainly in a quadrupole lens action. After deflection of the electron beam, the spot obtained with such a gun, generally has, in the corners and at the edge of the target, a considerable haze partially or entirely surrounding the spot. The haze produces a region of low but disturbing light intensity near the spot.

SUMMARY OF THE INVENTION

It is therefore an object of the invention to provide a cathode-ray tube with considerably less haze around the spot than in the known cathode-ray tube.

According to the invention, the cathode-ray tube comprises, in an evacuated envelope an electron gun for generating an electron beam the electron gun includes, in succession, a cathode centered around an axis, a first and second grid each having an aperture therein, the first grid forming, in cooperation with the second grid, a non-rotationally symmetrical electron lens. The cross-section normal to the axis of the aperture opening in the first grid at the side facing the second grid is larger than and transversely elongated relative to the cross-section of the aperture opening at the side of the first grid facing the cathode.

In known cathode-ray tubes, the cross-sections of the first grid normal to the axis are substantially the same. This is because one continuous aperture has the same elongate shape on the sides of cathode and anode. As a result of this a non-symmetrical lens is also formed in cooperation with the cathode, which asymmetry is expressed in a quadrupole lens action. The quadrupole lens acts in the same direction as the previously mentioned quadrupole lens. In the cathode-ray tube according to the invention such quadrupole asymmetry is not or substantially not present on the cathode side. That is, the shape of the aperture opening on the side of the first grid adjacent the cathode is such that the electric field in the region between the first grid and the cathode is substantially axially symmetric. The cross-section of the aperture in the first grid on the cathode side may be circular. In order to influence the shape of the beam and hence of the target, however, the aperture may also be square or slightly oval. The surface of the aperture on the cathode side, however, is always much smaller than the surface of the aperture in a cross-section on the side of the second grid.

A non-symmetrical funnel-shaped aperture in the first grid may be constructed in a large number of ways. It is possible, for example, to provide it by etching, spark erosion and the like. However, it is alternatively possible for the first grid to be made from two plate-shaped parts which are secured together and extend normally to the axis. The plate-shaped part situated on the side of the second grid has an elongated aperture opening so that the increased aperture area and elongated shape is obtained in a simple manner.

BRIEF DESCRIPTION OF THE DRAWING

The present invention will now be described by way of example with reference to the accompanying drawings, in which:

FIG. 3 is a longitudinal sectional view of one of the three guns shown in FIG. 2, FIGS. 4 and 5 are cross-sectional views on the lines IV—IV and V—V respectively of FIG. 3, FIGS. 6 to 8 are views of another preferred embodiment of the first grid.

DESCRIPTION OF THE PREFERRED EMBODIMENTS

Figure 1:
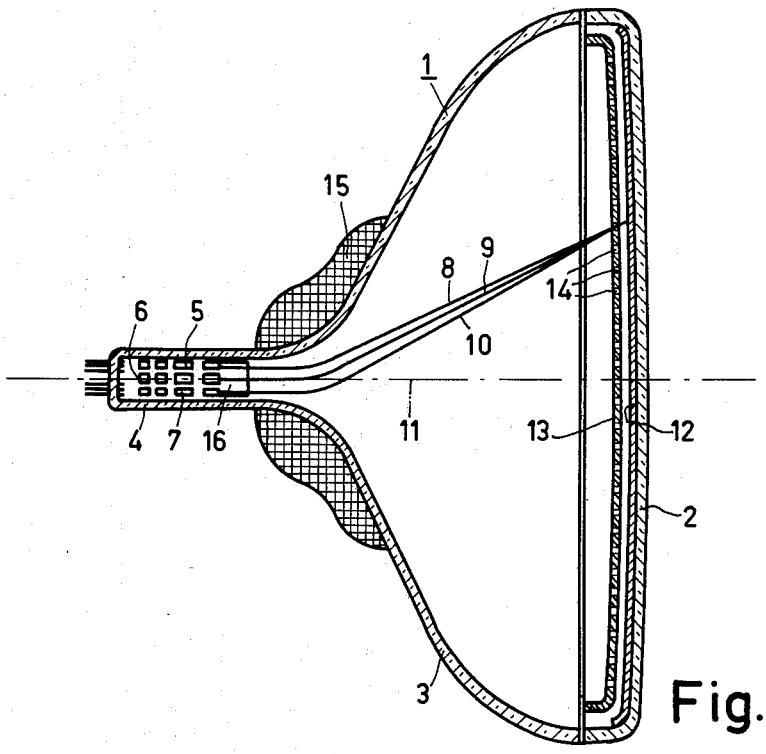
FIG. 1 is a sectional view of a cathode-ray tube made in accordance with the invention.

FIG. 1 is a diagrammatic sectional view of a cathode-ray tube in accordance with the invention, in this case a colour display tube of the in-line type. In a glass envelope 1 which is composed of a display window 2, a funnel-shaped part 3 and a neck 4, three electron guns 5, 6 and 7 are provided in the neck and generate the electron beams 8, 9 and 10, respectively. In a colour display tube of the in-line type the axes of the electron guns are located in one plane, in this case the plane of the drawing. The axis of the central electron gun 6 coincides substantially with the tube axis 11. The three electron guns debouch in a sleeve 16 which is positioned coaxially in the neck 4. The display window 2 has a large number of triplets of phosphor lines on its inside surface. Each triplet comprises a line consisting of a green-luminescing phosphor, a line consisting of a blue-luminescing phosphor and a line consisting of a red-luminescing phosphor. All triplets together constitute the display screen 12. The phosphor lines extend normally to the plane of the drawing. Provided in front of the display screen is a shadow mask 13 having a very large number of elongate apertures 14 which are parallel to the phosphor lines through which the electron beams 8, 9 and 10 pass. The electron beams are deflected in the horizontal direction (in the plane of the drawing) and in the vertical direction (normal thereto) by the deflection coil system 15. The three electron guns are assembled so that the axes thereof enclose a small angle with each other. As a result of this the generated electron beams pass through the apertures 14 at that angle, the so-called colour selection angle, and each impinges only on phosphor lines of one colour. The three electron guns 5, 6 and 7 may have one or more electrodes in common, as described, for example, in U.S. Pat. No. 3,772,554. It will be obvious that the invention may also be used in such a system of electron guns.

Figure 2:
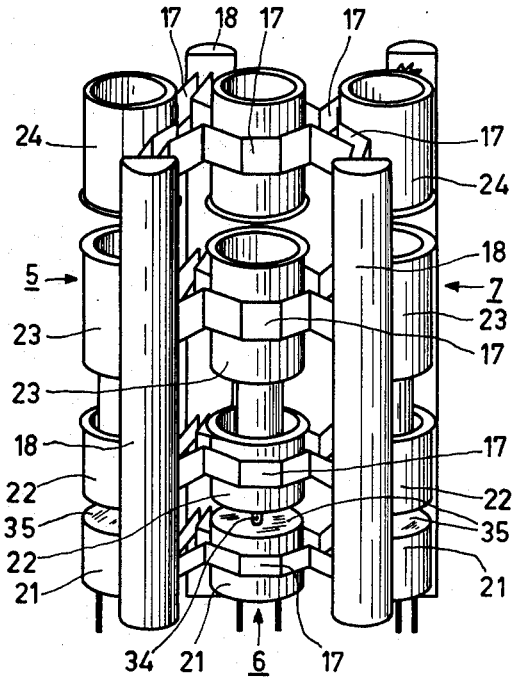
FIG. 2 is a perspective view of a three-fold electron gun for a cathode-ray tube in accordance with the invention.

FIG. 2 is a perspective view of the three electron guns 5, 6 and 7. The electrodes of the electron gun system are positioned with respect to each other by means of metal strips 17 which are sealed in glass assembly rods 18. Each gun comprises a first grid 21 and three other grids 22, 23 and 24.

FIG. 3 is a longitudinal sectional view of one of the guns shown in FIG. 2. A rapidly heating cathode 19 is positioned in the first grid 21. A coiled heating wire 28 is disposed in a cathode shaft or cylinder 29 which has an emissive surface consisting of a barium-strontium oxide layer opposite an aperture 34 in the first grid 21. The cathode cylinder is secured to a supporting cylinder 33 by means of three thin metal strips 30. The supporting cylinder is mounted in the first grid 21 by means of glass 31 secured in a metal ring. The supporting rods 32 are also sealed in the glass 31 so as to secure the filament in the cathode. Aperture 34 is provided in the first grid by means of an etching process.

FIG. 4 is a sectional view along line IV—IV of FIG. 3 showing the surface 36 of the first grid 21. On this side of grid 21, the aperture opening 34 is of circular cross-section.

FIG. 5 is a view along line V—V of FIG. 3 showing the surface 35 of the first grid 21. On this side the aperture has an elongate shape in that an elongate pit 37 is etched in the first grid. By using such a first grid, a spot in the corners and at the edge of the display screen is obtained which is surrounded by a negligible haze.

Figure 6:
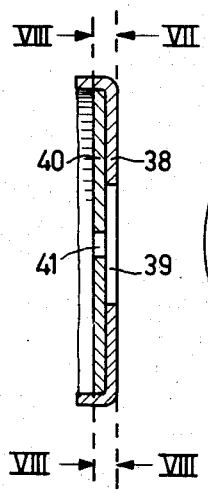
Figure 7:
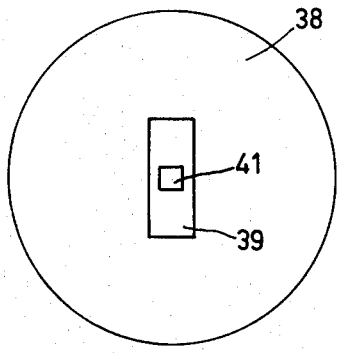
Figure 8:
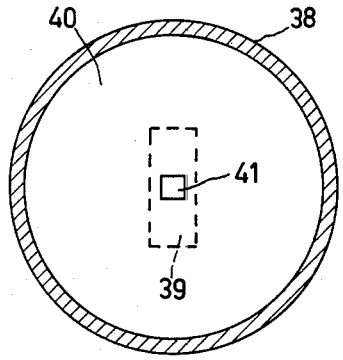

FIG. 6 is a cross-sectional view of another embodiment of a first grid which can be obtained in a simple and cheap manner. In this case the first grid comprises a plate-shaped part 38 having a rectangular aperture 39, as shown in FIG. 7, which is a view on the line VII—VII of FIG. 6, and a plate-shaped part 40 placed against it and having therein a small square aperture 41, as shown in FIG. 8 which is a view on the line VIII—VIII of FIG. 6. By making the shape of aperture 41 square, the shape of the spot can be influenced. As a result of the elongate aperture 39 a quadrupole lens action on the side of the second grid is obtained so that the haze around the spot in the corners and at the edge of the display screen is considerably reduced.

Figure 9:
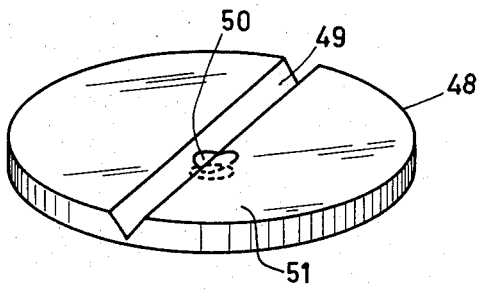
FIG. 9 is a perspective view of a further embodiment of a first grid.

FIG. 9 is a perspective view of another embodiment of a first grid. In a metal part 48 a V or U-shaped groove 49 and an aperture 50 are provided. The first grid is obtained by mounting the part 48 normal to the axis of the gun in such manner that the side 51 containing the groove 49 faces the second grid.

Figure 10:
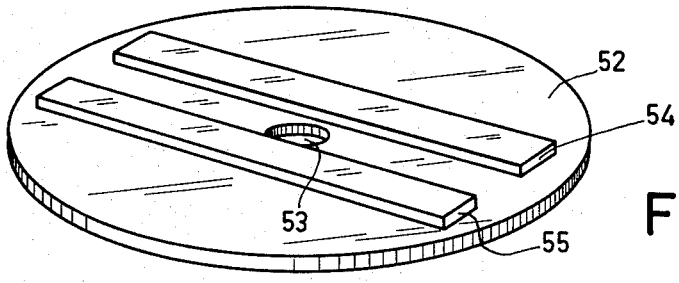
FIG. 10 is a perspective view of yet another embodiment of a first grid and FIGS. 11 and 12 are cross-sectional views of deflected electron beams, FIG. 11 being produced in a prior art cathode-ray tube and FIG. 12 in a cathode-ray tube made in accordance with the present invention.

FIG. 10 is also a perspective view of a first grid. The grid comprises a plate 52 having a circular aperture 53. On its side facing the second grid, the plate comprises two parallel metal strips 54 and 55. As a result of this the aperture in the cross-section of the first grid on the side of the second grid becomes infinitely long.

Figure 11:
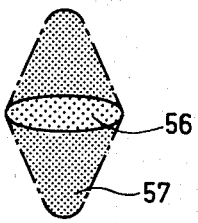

FIG. 11 shows a spot 56 of a deflected electron beam at the edge of a display screen of a known cathode-ray tube. The spot is surrounded by a haze 57, a region having a low but disturbing light intensity.

Figure 12:
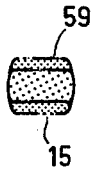

FIG. 12 shows a spot 58 of a deflected electron beam, which electron beam is generated by means of an electron gun having a first grid of the type described with reference to FIGS. 3 to 10. As indicated haze 59 is negligible and is unlikely to cause annoyance.

What is claimed is:

1. A cathode ray tube comprising, in an evacuated envelope, an electron gun for generating an electron beam, said electron gun including a cathode centered about an axis, a first grid positioned adjacent said cathode and spaced therefrom along said axis and a second grid spaced along said axis from said first grid, said first and second grids each having a portion extending normal to said axis and having an aperture formed therethrough at said axis, the aperture in said first grid defining a first opening on the side thereof adjacent said cathode of a shape such that a substantially axially symmetric electric lens is formed in the region between said cathode and said first grid, said aperture of said first grid further defining a second opening on the side of said first grid adjacent said second grid, said second opening being elongated in a direction normal to said axis and having a cross-sectional area larger than the cross-sectional area of said first opening, so that said first and second grids form a non-rotationally symmetric electron lens in the region therebetween.

2. The cathode ray tube according to claim 1 wherein the dimensions of said first opening in two orthogonal directions normal to said axis are substantially equal.

3. The cathode ray tube according to claim 2 wherein said portion of said first grid has, on the side thereof adjacent said second grid, a groove extending transversely of said axis and defining said second opening.

4. The cathode ray tube according to claim 2 wherein said first grid includes a pair of conductive, parallel strips spaced about said axis and secured to the side of said portion adjacent said second grid to define said second opening therebetween.

5. The cathode ray tube according to claim 3 or 4 wherein said first opening is circular.

6. The cathode ray tube according to claim 1 wherein said first opening is circular and said second opening is elliptical.

7. The cathode ray tube according to claim 1 wherein said first opening is square and said second opening is rectangular.

8. The cathode ray tube according to claim 1 wherein said first grid includes two apertured planar members secured to each other and defining said portion extending normal to said axis, the aperture in the planar member adjacent said cathode defining said first opening and the aperture in said planar member adjacent said second grid defining said second opening.

9. The cathode ray tube according to claim 8 wherein said aperture in said member adjacent said second grid is rectangular and the aperture in the planar member adjacent said cathode is square and is aligned with said rectangular aperture.

10. In a cathode ray tube having an electron gun, including a quadrupolar lens, for generating an electron beam, deflection means for deflecting said beam and a screen for producing a spot in response to said beam, said electron gun having a cathode, a first grid and a second grid spaced in that order, whereby no other electrodes are between said first grid and cathode, and wherein said first grid has an aperture for said beam that is shaped to compensate for the astigmatic effect of said quadrupolar lens; the improvement in said electron gun for reducing haze in said spot at the corners and edge of said screen wherein the end of said aperture in said first grid towards said cathode is substantially rotationally symmetrical and the end of said aperture towards second grid is elongated and has a cross-section greater than the end thereof towards said cathode grid.

11. The cathode ray tube of claim 10 wherein said aperture, at the end towards said cathode, is square.

12. The cathode ray tube of claim 10 wherein the end of said aperture towards said second grid is wider than the end of said aperture towards said cathode in all directions normal to said beam.

13. The cathode ray tube of claim 10 wherein the end of said aperture towards said second grid is rectangular.

14. The cathode ray tube of claim 11 wherein the end of said aperture towards said cathode is square.

15. The cathode ray tube of claim 10 wherein said first grid is comprised of first and second adjacent layers in the direction of said beam, said first and second layers defining the ends of said aperture towards said cathode and said second grid respectively.

* * * * *